US009166331B2

(12) United States Patent
Sato

(10) Patent No.: US 9,166,331 B2
(45) Date of Patent: Oct. 20, 2015

(54) CONNECTOR TERMINAL WITH A RESIN MOLD COVERING ITS BARREL PORTION CONNECTED TO A CABLE CONDUCTOR

(75) Inventor: Kei Sato, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/240,102

(22) PCT Filed: Aug. 17, 2012

(86) PCT No.: PCT/JP2012/071371

§ 371 (c)(1),
(2), (4) Date: Feb. 21, 2014

(87) PCT Pub. No.: WO2013/027811

PCT Pub. Date: Feb. 28, 2013

(65) Prior Publication Data

US 2014/0194002 A1 Jul. 10, 2014

(30) Foreign Application Priority Data

Aug. 23, 2011 (JP) ..... 2011-181777

(51) Int. Cl.

| | |
|---|---|
| ***H01R 13/40*** | (2006.01) |
| ***H01R 13/52*** | (2006.01) |
| ***H01R 4/70*** | (2006.01) |
| *H01R 4/18* | (2006.01) |

(52) U.S. Cl.

CPC ..... *H01R 13/5216* (2013.01); *H01R 4/70* (2013.01); *H01R 13/5205* (2013.01); *H01R 4/185* (2013.01)

(58) Field of Classification Search

USPC ..... 439/587–589

See application file for complete search history.

(56) References Cited

U.S. PATENT DOCUMENTS

| | | | | |
|---|---|---|---|---|
| 5,954,533 | A | 9/1999 | Hatagishi et al. | |
| 2011/0070770 | A1 | 3/2011 | Sakai et al. | |
| 2014/0106628 | A1* | 4/2014 | Sato | 439/877 |
| 2014/0165393 | A1* | 6/2014 | Sato | 29/858 |
| 2014/0194003 | A1* | 7/2014 | Nabeta | 439/604 |
| 2014/0206245 | A1* | 7/2014 | Sato | 439/878 |

(Continued)

FOREIGN PATENT DOCUMENTS

| | | | |
|---|---|---|---|
| CN | 1161583 | A | 10/1997 |
| JP | 62-153785 | U | 9/1987 |

(Continued)

OTHER PUBLICATIONS

International Search Report (PCT/ISA/210) for International Application No. PCT/JP2012/071371, issued Nov. 6, 2012.

(Continued)

*Primary Examiner* — Chandrika Prasad

(74) *Attorney, Agent, or Firm* — Sughrue Mion, PLLC

(57) ABSTRACT

A connector terminal (10) includes a terminal main body that includes a barrel portion (21) to which a core wire (12) exposed from an outer cover (13) of an electric cable (11) is electrically connected, and a tab terminal portion (31) that is electrically connected to a mating terminal, and a resin mold (15) that covers the barrel portion (21) and an end portion of the electric cable (11). The connector terminal (10) is inserted in a cavity (52) formed in a housing (51) and then accommodated in the housing (51) so that a rear end portion of the resin mold (15) is arranged in the inside of the cavity (52).

3 Claims, 5 Drawing Sheets

(56) References Cited

U.S. PATENT DOCUMENTS

| | | | | |
|---|---|---|---|---|
| 2014/0235117 | A1* | 8/2014 | Sato | 439/877 |
| 2015/0017833 | A1* | 1/2015 | Sato et al. | 439/519 |

FOREIGN PATENT DOCUMENTS

| | | | |
|---|---|---|---|
| JP | 10-040975 | A | 2/1998 |
| JP | 2009-230998 | A | 10/2009 |

OTHER PUBLICATIONS

Written Opinion (PCT/ISA/237); for International Application No. PCT/JP2012/071371, issued Nov. 6, 2011.

Office Action dated Mar. 10, 2014, issued by the Japanese Patent Office in counterpart Japanese Application No. 2011-181777.

Office Action and Search Report dated Jul. 2, 2015, issued by The State Intellectual Property Office of P.R. China in counterpart Chinese Application No. 201280041249.6.

* cited by examiner

CONNECTOR TERMINAL WITH A RESIN MOLD COVERING ITS BARREL PORTION CONNECTED TO A CABLE CONDUCTOR

TECHNICAL FIELD

The present invention relates to a connector terminal to be accommodated in a housing and a connecting structure of the connector terminal to the housing.

BACKGROUND ART

In the related art, a junction section of a connector terminal to an electric cable is protected through being molded of synthetic resin (for example, see Patent Literature 1).

CITATION LIST

Patent Literature

Patent Literature 1: JP-UM-A-62-153785

SUMMARY OF INVENTION

Technical Problem

A connector terminal 1 in which an electric cable 2 and a junction section 3 are formed integrally by a resin mold 4 as shown in FIG. 6, is inserted and accommodated in a cavity 6 formed in a housing 5 from a rear end of the housing 5 of a connector as shown in FIG. 7. Thus, the housing 5 is connected to a mating housing and thereby the connector terminal 1 is electrically connected to a connector terminal of the mating housing.

However, when a dimension from a rear end of the connector terminal 1 to a rear end of a resin mold 4 is long, for example, when the length is greater than the diameter of the electric cable 2, the resin mold 4 may be protruded from the rear end of the housing 5 as shown in FIGS. 8 and 9.

In this state, when a bending force acts on the electric cable 2, a large load is applied to the resin mold 4 which is protruded from the housing 5. Then, there are concerns that the resin mold 4 will be damaged and that the protection of the connection position between the connector terminal 1 and the electric cable 2 will not be sufficient.

Specifically, in a case where an aluminum electric cable and a copper terminal are pressed and connected each other, water can enter from the damaged position of the resin mold 4 and the connection position formed by different types of metals is permeated by the water and thereby electrolytic corrosion such as bimetallic contact corrosion may occur.

The present invention is made in view of the situation described above. An object of the present invention is to provide a connector terminal which can obtain favorable protection and corrosion resistance at the connection portion with the conductor.

Solution to Problem

In order to achieve the object described above, a connecting structure and a connector terminal according to aspects of the present invention may be configured by any of the followings (1) to (3).

(1) A connecting structure including a connector terminal and a housing including a cavity, the connector terminal including:

a terminal main body that includes a barrel portion to which a conductor exposed from an outer cover of an electric cable is electrically connected, and a tab terminal portion to be electrically connected to a mating terminal; and a resin mold that covers the barrel portion and an end portion of the electric cable, wherein the connector terminal is inserted in the cavity of the housing and accommodated in the housing so that a rear end portion of the resin mold is arranged inside the cavity.

(2) The connecting structure according to the configuration (1), wherein a dimension from a rear end of the terminal main body to the rear end of the resin mold is equal to or less than a diameter of the electric cable.

(3) A connector terminal, including:

a terminal main body that includes a barrel portion to which a conductor exposed from an outer cover of an electric cable is electrically connected, and a tab terminal portion to be electrically connected to a mating terminal; and a resin mold that covers the barrel portion and an end portion of the electric cable, wherein a dimension from a rear end of the terminal main body to the rear end of the resin mold is equal to or less than a diameter of the electric cable.

In the connecting structure of the configuration (1) or the connector terminal of the configuration (3) described above, the resin mold of the connector terminal can be arranged inside the cavity without protruding from the rear end of the housing in an accommodated state in the cavity of the housing, so that deformation due to bending of the resin mold can be reliably suppressed by a wall surface of the cavity. Accordingly, even though a bending force acts on the electric cable, the load applied to the resin mold can be significantly suppressed, damage to the resin mold is prevented and the connection position between the barrel portion and the electric cable can be maintained in a reliably protected state. In addition, the waterproof property of the connection position of the electric cable can be maintained favorably for a long period of time by the resin mold and high connection reliability can be obtained.

Specifically, even in a case where the aluminum electric cable and the copper terminal are pressed and connected, the connection position which is formed by different metals can be reliably waterproofed using the resin mold and electrolytic corrosion such as bimetallic contact corrosion can be reliably prevented.

In the connecting structure of the configuration (2) or the connector terminal of the configuration (3) described above, a dimension from the rear end of the terminal main body to the rear end of the resin mold is equal to or less than the diameter of the electric cable and is extremely short and thus the resin mold is hardly bent. Thus, the load due to bending of the resin mold can be alleviated and thereby damage to the resin mold can be favorably prevented and the connection position between the barrel portion and the electric cable can be maintained in the reliably protected state. In addition, the waterproof property of the connection position of the electric cable by the resin mold can be maintained favorably for a long period of time and high connection reliability can be obtained.

Advantageous Effects of Invention

According to the present invention, a connector terminal can be provided, which can have a favorable waterproof property and corrosion resistance ability in the connection position of the conductor.

Hereinabove, the present invention is described briefly. Details of the present invention will be clarified further by reading through the embodiment of the present invention described below with reference to the attached drawings.

DESCRIPTION OF EMBODIMENTS

Hereinafter, an embodiment of the present invention is described with reference to the drawings.

Figure 1:
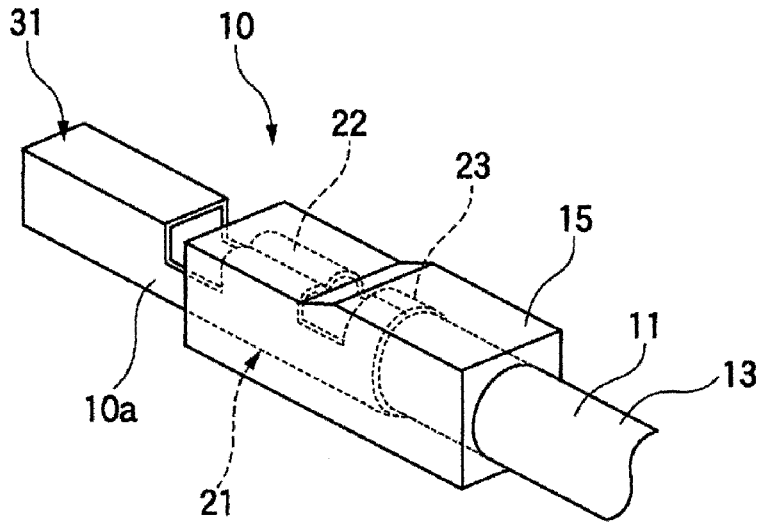
FIG. 1 is a perspective view of a connector terminal according to an embodiment.
Figure 2:
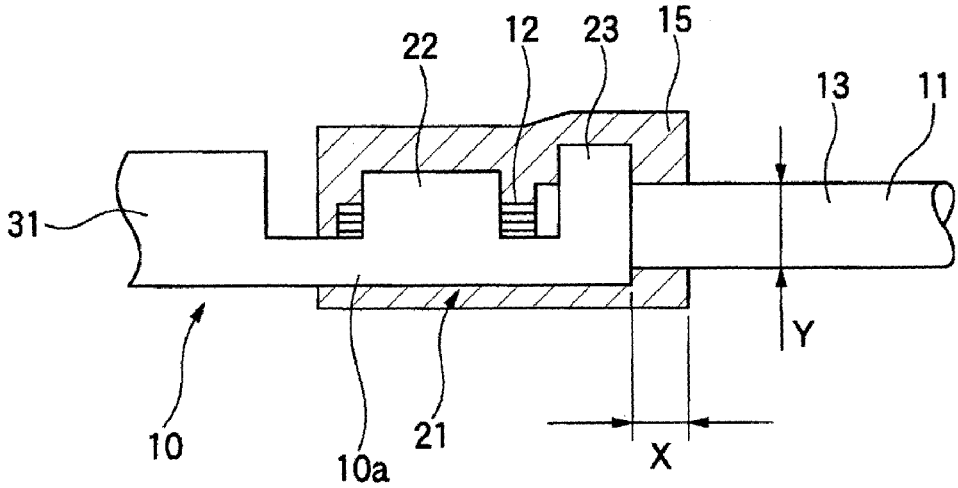
FIG. 2 is a side view of the connector terminal according to the embodiment.
Figure 3:
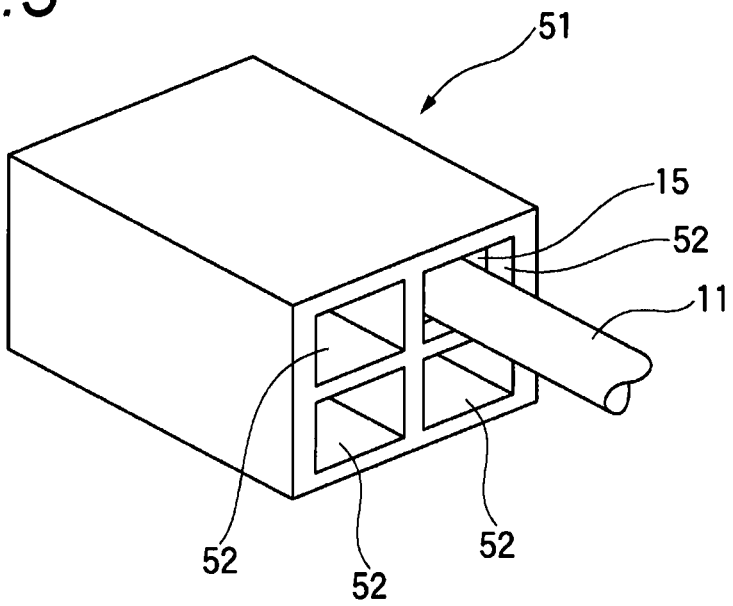
FIG. 3 is a perspective view of a housing in which the connector terminal is accommodated, as seen from the rear side.
Figure 4:
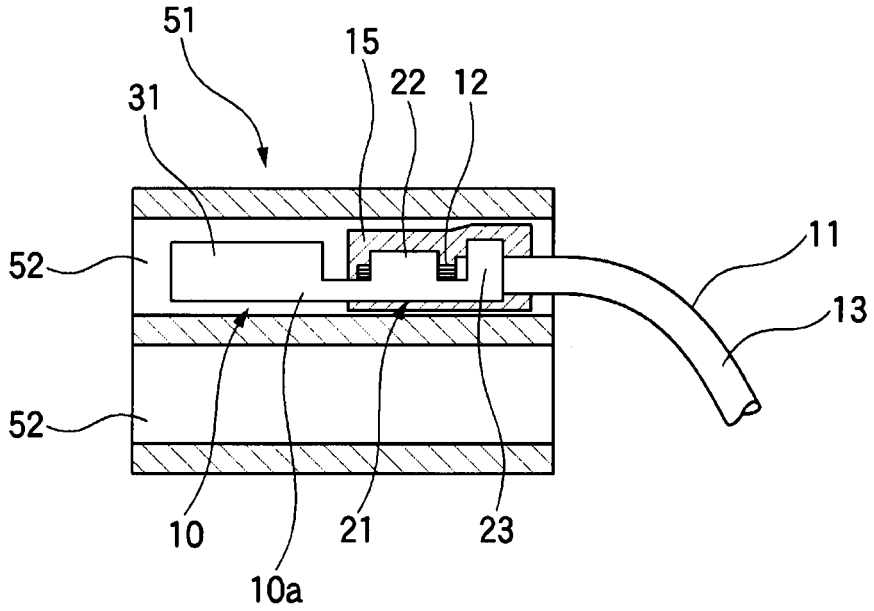
FIG. 4 is a schematic side cross-sectional view of the housing in which the connector terminal is accommodated.
Figure 5:
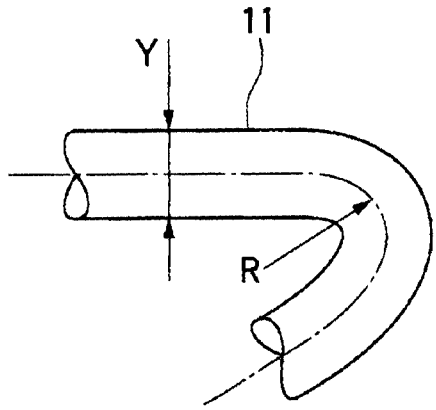
FIG. 5 is a side view illustrating a bending state of an electric cable.
Figure 6:
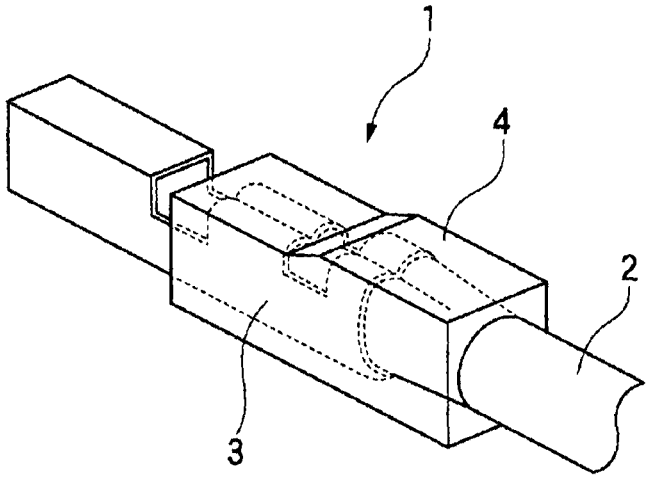
FIG. 6 is a perspective view of a connector terminal of the related art in which a connection position to an electric cable is sealed by a resin mold.
Figure 7:
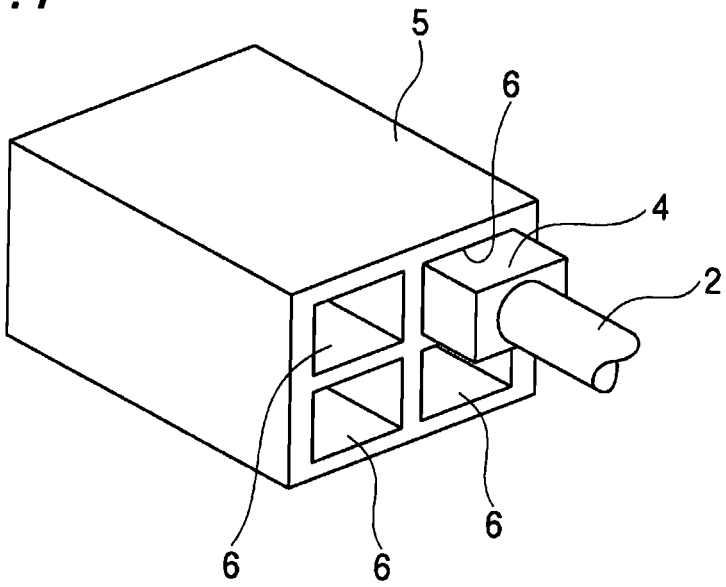
FIG. 7 is a perspective view of a housing in which a connector terminal of the related art is accommodated, as seen from the rear side.
Figure 8:
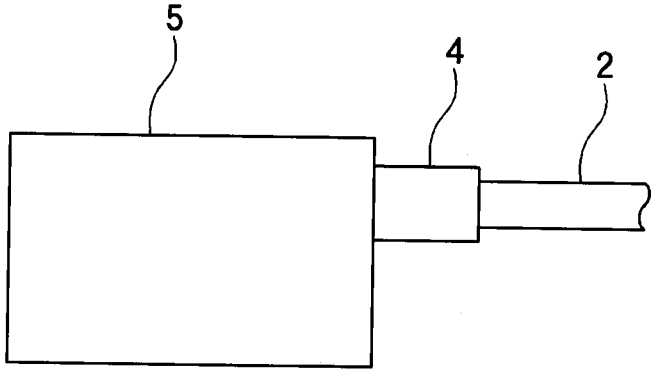
FIG. 8 is a schematic side view of a housing in which a connector terminal of the related art is accommodated.
Figure 9:
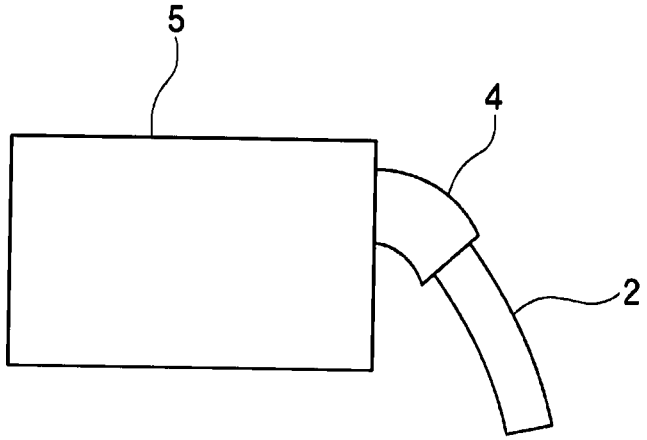
FIG. 9 is a schematic side view of a housing in which a connector terminal of the related art is accommodated.

FIG. 1 is a perspective view of a connector terminal according to the embodiment, FIG. 2 is a side view of the connector terminal according to the embodiment, FIG. 3 is a perspective view of a housing in which the connector terminal is accommodated, as viewed from the rear side, FIG. 4 is a schematic side cross-sectional view of the housing in which the connector terminal is accommodated, and FIG. 5 is a side view illustrating a bending state of an electric cable.

As shown in FIGS. 1 and 2, a connector 10 is formed of a conductive metal material of copper, copper alloy or the like by press processing and includes a barrel portion 21 and a tab terminal portion 31.

An electric cable 11, in which the connector terminal 10 is connected, has, for example, a core wire (a conductor) 12 formed of aluminum or aluminum alloy, and an outer cover 13 which is protruded and coated around the core wire 12.

The barrel portion 21 has a core wire crimp part 22 and an outer cover crimp part 23. The core wire crimp part 22 compresses the core wire 12 exposed at an end portion of the electric cable 11. Accordingly, the core wire 12 of the electric cable 11 and the connector terminal 10 are electrically connected. In addition, the outer cover crimp part 23 compresses the outer cover 13 in the end portion of the electric cable 11. Accordingly, a part of the outer cover 13 of the electric cable 11 is fixed to the connector terminal 10.

In addition, the connector terminal 10 is covered by a resin mold 15 around the periphery of the barrel portion 21 and an end portion of the electric cable 11. As described above, in the connector terminal 10, the connection position between the barrel portion 21 and the electric cable 11 is covered by the resin mold 15 and thereby the connection position of the electric cable 11 can be reliably protected and waterproofed. As in this example, when the electric cable 11, which has the core wire 12 formed of aluminum or aluminum alloy, is connected to the connector terminal 10 formed of copper or copper alloy, there is a tendency for electrolytic corrosion such as bimetallic contact corrosion to arise in the connection position due to the connection position being permeated by water position. However, the connection position is covered by the resin mold 15 so that high corrosion resistance can be obtained in the connection position.

The connector terminal 10 is configured such that a dimension X from the rear end of a terminal main body 10*a* formed of the metal material having the barrel portion 21 and the tab terminal portion 31 to the rear end of the resin mold 15 is equal to or less than a diameter Y of the electric cable 11 ($X \leq Y$).

As shown in FIGS. 3 and 4, the connector terminal 10 is accommodated in a housing 51 of the connector. The housing 51 is molded from a synthetic resin and has a plurality of cavities 52. Thus, the connector terminal 10 is inserted in each of the cavities 52 from rear end thereof and thereby the connector terminal 10 is accommodated in the housing 51.

As described above, the housing 51 which accommodates the connector terminal 10 is connected to a mating housing. Accordingly, the connector terminal 10 of the housing 51 is electrically connected to a mating connector terminal of the housing.

Here, the connector terminal 10 is arranged inside the cavity 52 in an accommodated state in the housing 51 without the rear end of the resin mold 15 protruding from the rear end of the housing 51.

In addition, in the connector terminal 10, since the dimension X from the rear end of the terminal main body 10*a* to the rear end of the resin mold 15 is equal to or less than the diameter Y of the electric cable 11 ($X \leq Y$), a distance from the rear end of the terminal main body 10*a* to the rear end of the resin mold 15 can be extremely short while ensuring a sufficient protection effect and waterproof effect.

As described above, in the housing 51 which accommodates the connector terminal 10, as shown in FIG. 4, even though a bending force acts on the electric cable 11, since the connector terminal 10 is arranged in the inside of the cavity 52 in an accommodated state in the housing 51 without the resin mold 15 of the connector terminal 10 protruding from the rear end of the housing 51, deformation due to bending of the resin mold 15 can be reliably suppressed by a wall surface of the cavity 52.

In addition, since the dimension X from the rear end of the terminal main body 10*a* of the connector terminal 10 to the rear end of the resin mold 15 is equal to or less than the diameter Y of the electric cable 11 ($X \leq Y$), the distance thereof is extremely short, the resin mold 15 is hardly bent and thereby a load due to bending of the resin mold 15 can be alleviated. In addition, generally, as shown in FIG. 5, in the electric cable 11, bending, in which a bending radius R is equal to or less than the diameter Y of the electric cable 11 ($R \leq N$), is difficult to occur. Accordingly, if the dimension X from the rear end of the terminal main body 10*a* to the rear end of the resin mold 15 is equal to or less than the diameter Y of the electric cable 11, sufficient durability with respect to the bending force can be obtained.

As described above, according to the connector terminal of the embodiment, since the connector terminal 10 is arranged in the inside of the cavity 52 in an accommodated state in the cavity 52 of the housing 51 without the resin mold 15 of the connector 10 protruding from the rear end of the housing 51, deformation due to bending of the resin mold 15 can be reliably suppressed by the wall surface of the cavity 52. Thus, even though the bending force acts on the electric cable 11, the load applied to the resin mold 15 can be significantly suppressed, damage to the resin mold 15 is prevented and the connection position between the barrel portion 21 and the electric cable 11 can be maintained in a reliably protected state. In addition, the waterproof property of the connection position of the electric cable 11 can be maintained favorably by the resin mold 15 for a long period of time and high connection reliability can be obtained.

Specifically, even in a case where the aluminum electric cable and the copper terminal are crimped and connected, the connection position formed of different types of metals can be reliably waterproofed with the resin mold 15 and electrolytic corrosion such as bimetallic contact corrosion can be reliably prevented.

In addition, since the dimension X from the rear end of the terminal main body 10*a* to the rear end of the resin mold 15 is equal to or less than the diameter Y of the electric cable 11, the distance thereof is extremely short, the resin mold 15 is hardly bent and thereby a load due to bending of the resin mold 15 can be alleviated. Accordingly, damage to the resin mold 15 can be favorably prevented and the connection position between the barrel portion 21 and the electric cable 11 can be maintained in a reliably protected state. In addition, the waterproof property of the connection position of the electric cable 11 can be maintained favorably by the resin mold 15 for a long period of time and high connection reliability can be obtained.

In addition, the present invention is not limited to the embodiments described above and can be appropriately altered, improved, or the like. In addition, material, shape, dimension, number, arrangement position, or the like of each of the configuration elements in the embodiment described above is arbitrary and is not limited if it can achieve the effects of the present invention.

The present application is based upon and claims the benefit of Japanese patent application No. 2011-181777 filed on Aug. 23, 2011, the contents of which are incorporated by reference in its entirety.

INDUSTRIAL APPLICABILITY

According to the present invention, it is useful to use the connector terminal, especially in a place where water, obstacles or the like can enter, since the connector has favorable protection and corrosion resistance ability in a connection position of a conductor.

REFERENCE SIGNS LIST

10: connector terminal
11: electric cable
12: core wire (conductor)
13: outer cover
15: resin mold
21: barrel portion
31: tab terminal portion
51: housing
52: cavity

The invention claimed is:

1. A connecting structure, comprising a connector terminal and a housing including a cavity, the connector terminal, comprising:

a terminal main body that includes a barrel portion to which a conductor exposed from an outer cover of an electric cable is electrically connected, and a tab terminal portion to be electrically connected to a mating terminal; and a resin mold that covers the barrel portion and an end portion of the electric cable, wherein the connector terminal, including the terminal main body and the resin mold thereon, is inserted in the cavity of the housing and accommodated in the housing so that a rear end portion of the resin mold is arranged inside the cavity.

2. The connecting structure according to claim 1, wherein a dimension from a rear end of the terminal main body to the rear end of the resin mold is equal to or less than a diameter of the electric cable.

3. A connector terminal, comprising:

a terminal main body that includes a barrel portion to which a conductor exposed from an outer cover of an electric cable is electrically connected, and a tab terminal portion to be electrically connected to a mating terminal; and a resin mold that covers the barrel portion and an end portion of the electric cable, wherein a dimension from a rear end of the terminal main body to the rear end of the resin mold is equal to or less than a diameter of the electric cable.

* * * * *